United States Patent [19]

Teglasy et al.

[11] Patent Number: 4,618,074

[45] Date of Patent: Oct. 21, 1986

[54] COIN-OPERABLE MACHINE FOR DISPENSING COOLING ELEMENTS

[76] Inventors: György Teglasy, Masenkamp 62, 2000 Hamburg 62; Ludwig Galambos, Lawaetzweg 7, 2000 Hamburg, both of Fed. Rep. of Germany

[21] Appl. No.: 659,647

[22] Filed: Oct. 11, 1984

[30] Foreign Application Priority Data

Oct. 27, 1983 [DE] Fed. Rep. of Germany ... 8330770[U]
Jul. 27, 1984 [DE] Fed. Rep. of Germany ... 8422376[U]

[51] Int. Cl.[4] ..... G07F 7/06; G07F 9/10

[52] U.S. Cl. ..... 221/15; 211/150 R; 211/281

[58] Field of Search ..... 194/10, 2, 9 T; 221/150 R, 66, 15, 281; 222/644, 638; 62/231, 158; 134/61, 107, 200, 198

[56] References Cited

U.S. PATENT DOCUMENTS

| | | | |
|---|---|---|---|
| 2,232,619 | 2/1941 | MacCartee et al. | 221/150 R X |
| 2,677,368 | 5/1954 | Janecek | 134/107 X |
| 2,756,168 | 7/1956 | Ruggles | 134/200 X |
| 3,049,302 | 8/1962 | Simmons, Jr. | 134/107 X |
| 3,529,610 | 9/1970 | Leichner et al. | 134/107 X |
| 3,580,261 | 5/1971 | Key | 134/200 X |
| 4,217,924 | 8/1980 | Finger | 137/334 |
| 4,353,323 | 10/1982 | Koblenzer | 134/107 X |
| 4,429,778 | 2/1984 | Levasseur | 194/9 T X |
| 4,512,811 | 4/1985 | Binnig et al. | 134/107 X |

FOREIGN PATENT DOCUMENTS

| | | | |
|---|---|---|---|
| 2258672 | 8/1975 | France | 221/150 R |

*Primary Examiner*—Joseph J. Rolla
*Assistant Examiner*—Edward S. Ammeen
*Attorney, Agent, or Firm*—Erwin S. Teltscher

[57] ABSTRACT

The coin-operable machine is used for "activating" used cooling elements, which are employed in cooler bags or boxes for keeping food fresh and keeping drinks cool and comprises a machine casing with a refrigerating chamber, into which a guideway issues from an upper insertion slot and in which the cooling elements are cooled by removing heat, the individual cooling elements being dispensed by inserting a coin and corresponding operation of a retaining and delivery device.

18 Claims, 3 Drawing Figures

COIN-OPERABLE MACHINE FOR DISPENSING COOLING ELEMENTS

BACKGROUND OF THE INVENTION

The invention relates to a coin-operable machine for dispensing cooling elements, particularly for the use thereof in cooler bags or boxes for keeping food fresh and keeping drinks cool.

For the purpose of cooling the content of cooler bags and boxes, it is known to use cooling elements comprising a plate-like casing closed on all sides and containing in the inner area thereof a cooling agent. The latter is a substance, which is gaseous under normal pressure and ambient temperature, but evaporates on cooling, which is brought about by introducing the cooling elements into a cooling zone, such as e.g. the refrigerating compartment of a refrigerator. The cooling effect in the cooler bags and boxes is achieved in that the cooling agent evaporates in the cooling elements, i.e. through the cooling agent passing from the liquid into the gaseous state, heat is taken from the surrounding environment.

However, it is disadvantageous that in the case of long journeys and for example when spending time on the beach, the cooling elements loose their cooling action after the cooler bags have been opened and closed several times and there is no possibility of cooling the "warm" cooling elements, in order to achieve a further cooling effect in the cooler bags and boxes.

SUMMARY OF THE INVENTION

The problem of the present invention is to provide a coin-operable machine with a cooling device, which makes it possible to replace used cooling elements by "activated" cooling elements, i.e. elements which have been recooled and are available for cooling purposes on paying a fee. In addition, the activated cooling elements dispensed must be completely hygienically satisfactory.

The present invention therefore specifically relates to a coin-operable machine for dispensing cooling elements, particularly for the use thereof in cooler bags and boxes for keeping food fresh and for keeping drinks cool, wherein a box-shaped machine casing has in its front panel an upper cooling element insertion slot and in the lower casing region a cooling element removal slot, as well as a refrigerating compartment of a refrigerator, the cooling element insertion slot being connected with the cooling element removal slot by means of a guideway passing through the refrigerating compartment, and wherein a coin-controlled retaining and delivery device is provided in the vicinity of the cooling element removal slot.

It is possible with a machine constructed in this way to replace cooling elements which no longer have any cooling effect by cooling elements which can again be used for cooling purposes through the payment of a fee. For this purpose, used cooling elements are merely fed into the machine and by inserting a coin the delivery device of the machine is operated, so that a recooled cooling element can be removed therefrom and used for cooling purposes. Due to the fact that a refrigerating compartment is formed in the inner area of the machine through which the cooling elements to be cooled are passed or in which these elements spend a period of time, it is ensured that the machine user always has well cooled cooling elements available to him.

The invention also relates to a coin-operable machine for dispensing cooling elements, particularly for the use thereof in cooler bags and boxes for keeping food fresh and keeping drinks cool, wherein a box-shaped machine casing has in the upper area of its front panel a cooling element insertion slot and in the lower casing area a cooling element removal slot, which is connected to the cooling element insertion slot by means of a chute-like guideway in the inner area of the machine casing and whose upper area is constructed as a cooling element cleaning chamber and which following onto the latter is passed through the refrigerating compartment of a refrigerator, and wherein in the vicinity of the cooling element removal slot is provided a coin-controlled retaining and delivery device.

It is also possible in the case of a machine constructed in the above manner to replace cooling elements no longer having a cooling effect by cooling elements which can again be used for cooling purposes by the payment of a fee. For this purpose, used cooling elements are merely supplied to the machine and by inserting a coin, the machine delivery device is operated, so that a recooled cooling element can be removed therefrom and can be used for cooling purposes.

In the case of this coin-operable machine, a further advantage results from the fact that the used cooling elements no longer having any cooling effect are initially cleaned after being introduced into the machine prior to their passing into the vicinity of the cooling zone and being dispensed. The cooling elements fed into the machne are often not in a hygienically satisfactory state and can be contaminated by hardened food residues and the like as a result of their being used in cooler bags and boxes. Due to the fact that the cooling elements are cleaned before they reach the cooling zone, hygienically satisfactory, clean cooling elements are always dispensed, so that the user of the new cooling elements always receives them in a completely clean state.

Further appropriate developments of the invention are characterized in the dependent claims. In particular, the retaining and delivery device for the individual cooling element can be linked with a timer. By means of the timer, the residence time of the cooling elements in the machine refrigerating compartment is predetermined and established, which ensures that on removing in a successive manner a relatively large number of cooled cooling elements, no inadequately cooled elements are dispensed.

A machine constructed in accordance with the invention can be used as a standing or wall-fitted machine and can be set up at road-houses, highway service areas, adjacent to beaches, i.e. everywhere where there is a need for such cooling elements. It is merely necessary to provide a power supply outlet for operating the refrigerator.

BRIEF DESCRIPTION OF THE DRAWINGS

The invention is described in greater detail hereinafter relative to non-limitative embodiments and the attached drawings, wherein.

DETAILED DESCRIPTION OF THE PREFERRED EMBODIMENTS

Figure 1:
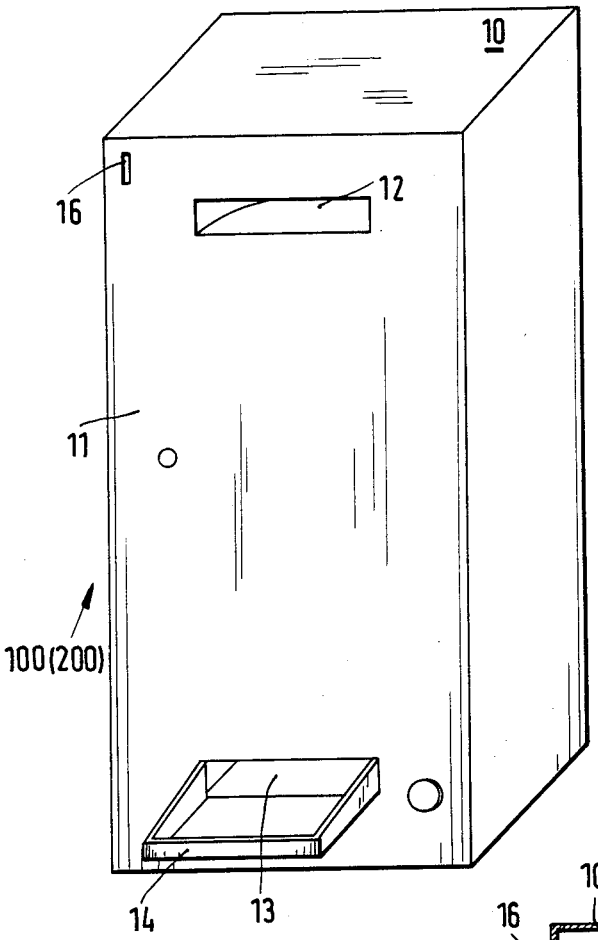
FIG. 1 is a cooling element dispensing machine in a diagrammatic view.
Figure 2:
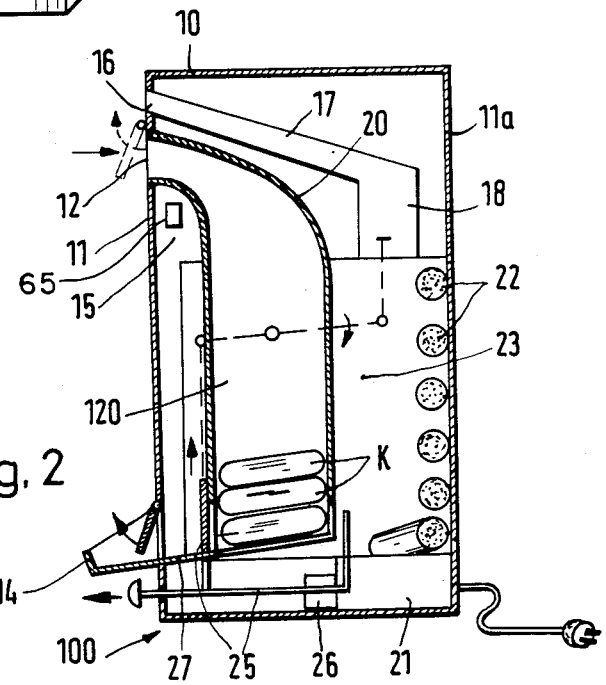
FIG. 2 is the machine of FIG. 1, partly in vertical section and partly in elevation.

According to the embodiment shown in FIGS. 1 and 2, the coin-operable machine 100 for dispensing cooling elements comprises a box-shaped machine casing 10, which can be provided with a stand, not shown in the drawing, to enable the same to be set up in a free-standing manner. In the upper area of the front panel 11 of machine casing 10 is provided a cooling element insertion slot 12, whilst its lower area has a cooling element removal slot 13, which communicates with a delivery tray or receptable 14. The rear wall 11*a* of the machine casing 10 can be provided with a wall fixture, which is not shown in the drawing, to enable the machine 100 to be fixed to a vertical wall or the like.

In addition, the front panel 11 of machine casing 10 has a coin slot 16 in FIG. 2, which leads via a coin guideway 17 to a coin checker 18 constructed in per se known manner and by means of which the individual coins operate a retaining and delivery device for the individual cooling elements indicated at 25.

The upper cooling element insertion slot 12 and the lower cooling element removal slot 13 are connected by means of a guideway 20 passing through the inner area 15 of machine casing 10 and which communicates with a chute 120, which is provided at the bottom with a closing plate controllable by means of the retaining and delivery device 25. In the discharge area of chute 120 for receiving the cooling elements is provided a delivery pipe 27, which leads to the cooling element removal slot 13 and slopes, so that the delivered cooling elements are in a correct position for removal in the vicinity of the delivery tray 14.

In the inner area 15 of machine casing 10 is constructed a refrigerating compartment 23, through which passes the guideway 20 or communicates therewith and to which is connected a cooling element receiving chute 120 connected to guideway 20.

The temperature in the refrigerating compartment 23 is maintained by a cooling coil system 22, which is connected to a refrigerator 21, which can be arranged in the inner area 15 of machine casing 10, but can also be positioned outside the latter, e.g. in its rear area. By means of refrigerator 21, the temperature in the refrigerating compartment 23 is maintained at such a level that the liquid of the cooling element K located in said refrigerating compartment solidifies on reaching the freezing point, or the gaseous substance evaporates.

The cooling element insertion slot 12 and the cooling element removal slot 13 are constructed for receiving and dispensing cooling element K constructed in per se known manner. These cooling elements are commercially available elements having standardized dimensions and which are formed from plate-like casings, which are closed on all sides and which contain a cooling agent, which is gaseous at normal pressure and ambient temperature, but evaporates on cooling. However, it is also possible to use liquids which solidify at the freezing point.

Machine 100 operates in such a way that on inserting a cooling element no longer having any cooling action into insertion slot 12 and after inserting a coin, either automatically, or by normal operation a new, cooled cooling element is conveyed into the removal area of the retaining and delivery device, a cooled cooling element is conveyed into the delivery tray or receptacle 14 through the removal slot 13, a retaining mechanism ensuring that removal of cooling elements is not possible without inserting coins. The retaining and delivery device 25 is constructed in per se known manner and may merely comprise a coin-operable slide, which can only be operated after a coin has been inserted and a locking mechanism has been raised by the inserted coin and the operating rod has been released. However, it is also possible to use other retaining and delivery devices.

Advantageously, the retaining and delivery device 25 is connected to a timer 26 by means of which the residence time of the cooling elements in the refrigerating compartment 23 is controlled, so as to ensure that when several cooling elements are removed in a very short time, the cooling elements entering the refrigerating compartment are adequately cooled.

Figure 3:
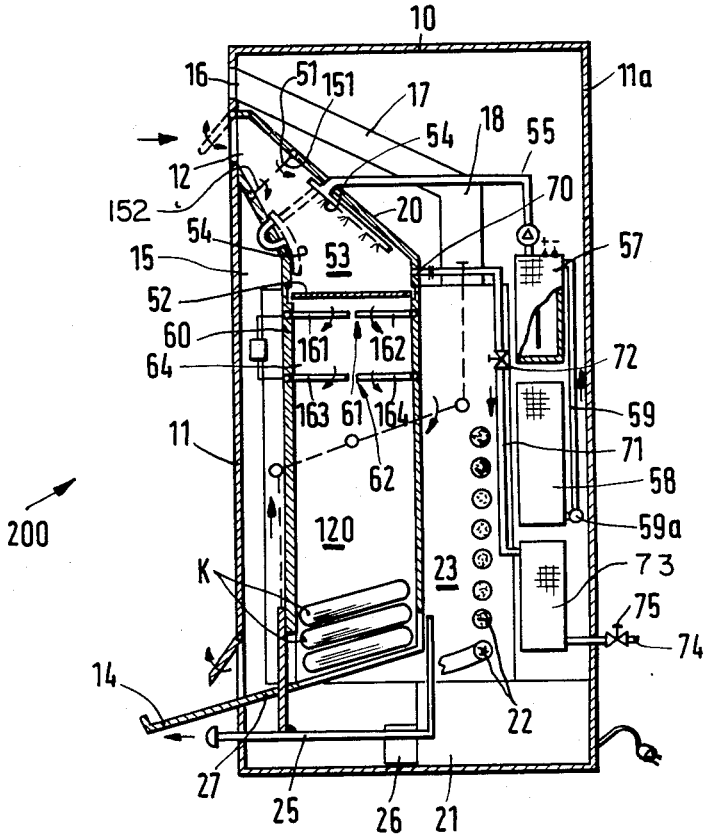
FIG. 3 is another embodiment of a cooling element dispensing machine with a cooling element cleaning device, partly in elevation and partly in vertical section.

According to the embodiment shown in FIG. 3, the coin-operable machine 200 for dispensing cooling elements also comprises a box-shaped machine casing 10. In the upper area of the front panel 11 of machine casing 10 is provided a cooling element insertion slot 12, whilst in its lower area there is a cooling element removal slot 13, which communicates with a delivery tray or receptacle 14. Rear wall 11*a* of machine casing 10 can be provided with a wall fixture not shown in the drawing, so that machine 100 can also be fixed to a vertical wall or the like.

In addition, front panel 11 of machine casing 10 has a coin slot indicated at 16 in FIG. 2, which leads via a coin guideway 17 to a coin checker 18 constructed in per se known manner and via which the individual coins operate a retaining and delivery device 25 for the individual cooling elements.

The upper cooling element insertion slot 12 and the lower cooling element removal slot 13 are connected by means of a guideway 20 passing through the inner area 15 of machine casing 10 and which is partly constructed as a chute 120, being provided at the bottom with a closing plate controllable by means of the retaining and delivery device 25. In the delivery area of chute 120 for receiving the cooling elements is provided a delivery pipe 27, which leads to the cooling element removal slot 13 and slopes, so that the dispensed cooling elements are brought into a position suitable for removal in the vicinity of the delivery tray 14.

In the inner area 15 of machine casing 10 is provided a refrigerating compartment 23, through which leads the guideway 20 or with which it communicates in which is located the cooling element receiving chute 120 connected to guideway 20.

Upstream of the cooling element receiving chute 120, located in the vicinity of refrigerating compartment 23, is provided a cleaning device in the form of a cleaning chamber 50, which is open at the top and bottom and to which is connected a lock chamber 60, to which further reference will be made hereinafter.

The temperature in the refrigerating compartment 23 is maintained by a cooling coil system 22, which is connected to a refrigerator 21, which can be located in the inner area 15 of machine casing 10, but can also be located outside the latter, e.g. in a rear area. By means of refrigerator 21, the temperature in the refrigerating compartment 23 is maintained at a level such that the liquid of the cooling elements K in the refrigerating compartment solidifies on reaching freezing point or the gaseous substance in the inner area of the cooling elements evaporates.

The cooling element insertion slot 12 and the cooling element removal slot 13 are constructed for receiving and dispensing elements K constructed in per se known manner. These cooling elements are commercially available elements, which have standard dimensions and which comprise a plate-like casing, which is closed on all sides and which contains a cooling agent, which is gaseous at normal pressure and ambient temperature, but evaporates on cooling. However, it is also possible to use liquids which solidify at freezing point.

By means of the cleaning chamber 50 in the machine casing 10, the used cooling elements introduced into the machine are firstly cleaned, before they reach the reception chute 120 in the vicinity of refrigerating compartment 23.

Cleaning chamber 50 is open at the top and bottom. On the cooling element infeed side, i.e. in the area adjacent to the cooling element insertion slot 12, the inner area 53 of cleaning chamber 50 can be closed by means of a closing mechanism 51, but the latter is constructed in such a way that inserted cooling elements can readily enter the cleaning chamber 50, but on putting the cleaning device in the cleaning chamber 50 into operation, the chamber inner area is sealed from the outside. This closing device 51 has in the inner area 53 of cleaning chamber 50 pivotable hinged flaps 151, 152, which are under the action of a spring in such a way that flaps 151, 152 are automatically changed from their open position to their closed position. On weight loading by the supplied cooling elements, the insertion opening to the inner area 53 of the cleaning chamber 50 is opened. On removing the weight loading on hinged flaps 151, 152, they pivot into their closed position by means of springs, which are not shown in the drawing. An inserted cooling element or several successively supplied cooling elements then come to rest in the cleaning chamber 50, where they are cleaned.

At the bottom, the cleaning chamber 50 can be closed by operable closing means such as a base plate 52, which is constructed in a laterally movable manner for freeing the bottom opening of cleaning chamber 50. This base plate 52 is arranged, held and guided on the bottom of the casing of cleaning chamber 50 in such a way that a water-tight seal or closure is achieved on the bottom when base plate 52 closes the bottom opening of cleaning chamber 50, as shown in FIG. 3.

The inner area 53 of cleaning chamber 50 contains a device 54, by means of which hot water or steam can by passed into the inner area of chamber 50. By means of nozzles arranged on the inner wall surface of the casing of cleaning chamber 50, hot water or steam uniformly acts on the cooling elements to be cleaned, but it is also possible to use differently constructed cleaning devices (FIG. 3).

Hot water is produced by means of a device 57 arranged in the inner area 15 of machine casing 10 and this can e.g. be constructed as a hot water boiler or the like. This hot water production device 57 is connected via a feed line 55 to the hot water spraying mechanism 54 in the inner area 53 of cleaning chamber 50. Feed line 55 contains a suction and pressure pump, in order to discharge pressurized hot water from the spraying mechanism 54. The hot water producing device 57 is connected via a feed line 59 with a water storage tank 58. This feed line 59 also contains a pump **59*a*, by means of which water from the water storage tank 58 is conveyed into the hot water producing device 57. The use of a water storage tank 58 is always advantageous if the hot water producing device 57 is not connected to any local water mains. Otherwise, the hot water producing device 57** can be directly connected to the local water mains.

The cooling element receiving chute 120 with the refrigerating compartment 23 can be directly connected to the cleaning chamber 50, that it is advantageous if a lock is provided between chute 120 or refrigerating compartment 23 and the cleaning chamber 50 to prevent warm air from the cleaning chamber 50 penetrating chute 120 on transferring cleaned cooling elements into the chute, which would only lead to an increased work output of the refrigerator 21.

In the case of the embodiment shown in FIG. 3, a lock chamber 60, which is open at both sides, is provided between cleaning chamber 50 and the cooling element receiving chute 120. The two openings of lock chamber 60 can be closed and opened again by means of closing mechanisms 61, 62, if a cleaned element is to be transferred from cleaning chamber 50 into the cooling element receiving chute 120. The two closing mechanisms 61, 62 are operated alternately in such a way that the closed closing mechanism 61 is open when the closing mechanism 62 is closed, whilst on opening closing mechanism 62, closing mechanism 61 is closed.

Both the closing mechanisms 61, 62 can be provided with hinged flaps 161, 162 and 163, 164. The pivoting of these hinged flaps 161, 162 or 163, 164 takes place in the direction of the arrows in FIG. 3 for freeing the openings. The flaps 161, 162 are advantageously under spring tension and are opened in the case of weight loading by a cooling element. When the cooling element has left the vicinity of the opened flaps 161, 162 and comes to rest on the closed hinged flaps 163, 164, flaps 161, 162 are automatically pivoted back into their closed position by means of the tension of the springs provided. The two hinged flaps 163,164 of closing mechanism 62 are only opened when hinged flaps 161, 162 have been pivoted back into their closed position. Flaps 163, 164 are forcibly controlled and this takes place as a function of the particular positions of hinged flaps 161, 162. The control of the flaps of the two closing mechanisms 61, 62 can also take place by means of a control and drive mechanism 65 provided in the inner area 15 of machine casing 10 and shown only schematically in FIG. 2, and which can also be used for alternately closing and opening the flaps of the two closing mechanisms. By means of this control and drive device 65, it is also possible to pivot the hinged flaps 151, 152 of closing mechanism 51 in cleaning chamber 50. All the other control operations, such as e.g. the supply of hot water into the inner area 53 of cleaning chamber 50 and the transfer of water from water storage tank 58 into the hot water producing device 57 can also take place in conjunction with the pumps 56 and **59*a* by means of the control and drive device 65. The height of inner area 64 of lock chamber 60 is fixed in such a way that the hinged flaps 161, 162 of closing mechanism 61 in the open position ensure the completely satisfactory depositing of an inserted cooling element on the closed flaps 163, 164 of closing mechanism 62**.

In order to be able to drain off water which has collected in cleaning chamber 50 after the cleaning process has been ended, in the vicinity of base plate 52 of chamber 50 a dirty water drain connection 70 is provided in the chamber casing wall and this is connected by a drain 71 to a dirty water collecting tank 73, which is also positioned in the inner area 15 of machine casing 10. Drain 71 contains a control valve 72, which is controlled by means of the dirty water outflow in tank 73.

The dirty water tank 73 is provided with a drain connection 74 passed through the wall of machine casing 10 and which is provided in the area outside casing 10 with a valve 75. A connection to a local sewer pipe or drain is possible by means of drain connection 74. It is also possible to directly lead drain 71 into a local sewer.

Machine 200 operates in such a way that after inserting a cooling element no longer having any cooling action into the insertion slot 12 and inserting a coin, automatically a new, cooled cooling element is passed into the removal area, it also being possible by manual operation of the retaining and delivery device to move a cooled cooling element into the delivery tray 14 through removal slot 13. A retaining mechanism ensures that removal of cooling elements is not possible without inserting a coin. The retaining and delivery device 25 is constructed in per se known manner and may merely comprise a coin-operable slide, which can only be operated after a coin has been inserted and a locking mechanism raised by the inserted coil, so as to release the operating rod. However, it is also possible to use other retaining and delivery devices.

Advantageously, the retaining and delivery device 25 is connected to a timer 26 which controls the residence time of the cooling elements in refrigerating compartment 23, to ensure that when several cooling elements are removed in a very short time, the following cooling elements entering the refrigerating compartment are not inadequately cooled.

A cooling element introduced into machine 200 because it no longer has any cooling action firstly passes into cleaning chamber 50 and there the cooling element is cleaned. During the cleaning process, the hinged flaps 151, 152 of closing device 51 are closed. In the same way, the bottom opening of cleaning chamber 50 is closed by base plate 52 during the cleaning process. After the cleaning of the coiling element, the bottom opening of cleaning chamber 50 is opened by removing base plate 52. The cleaned cooling element drops onto the hinged flaps 161, 162 of closing device 61, which are initially in the closed position. As a result of the weight loading, the two flaps 161, 162 pivot into the inner area 64 of lock chamber 60, as that the cooling element passes into the lock chamber inner area 64. After removing the weight loading, the two hinged flaps 161, 162 pivot into their closed position and simultaneously the base plate 52 is also passed into its closed position, so that on inserting a new cooling element to be cleaned, the cleaning process can be started afresh.

When the hinged flaps 161, 162 of closing mechanism 61 of lock chamber 60 have assumed their closed position, then hinged flaps 163, 164 of the lower closing mechanism 62 are swung out and the cleaned cooling element is passed into the cooling element receiving chute 120, which is located in the vicinity of refrigerating compartment 23. The cooling elements are now cleaned and made ready for dispensing again.

Closing mechanism 51, 61 and 62 can have other closing elements instead of the hinged flaps. It is also possible to use resilient elastic flap sections made from rubber or rubber-elastic materials in place of the spring-operated hinge flaps. Hinge flaps 163, 164 of closing mechanism 62 must however be constructed in such a way that they do not automatically open, but are subject to the action of a cooling element and are to be pressed down by the weight thereof.

What is claimed is:

1. A coin-operable machine for dispensing cooling elements, particularly for the use thereof in cooler bags and cooler boxes for keeping food fresh, and for keeping drinks cool, comprising in combination a box-shaped casing, including a refrigerating compartment for cooling a cooling element passing therethrough, a front panel formed in an upper region thereof with an insertion slot adapted to receive a cooling element, a guideway having a major portion thereof in an upright position, said major portion passing through said refrigerating compartment, the remaining portion of said guideway including a cooling element cleaning chamber, inlet and discharge means for passing and discharging hot water or steam into and from said cooling element cleaning chamber, respectively, and openable guideway closing means for said major portion of said guideway, said remaining portion being separated from the major portion of said guideway by said guideway closing means and, wherein said cleaning chamber has a cooling element discharge side, said guideway closing means comprising a base plate for selectively opening and closing a bottom opening of said cleaning chamber formed near said cooling element discharge side, and coin-controlled cooling-element retaining and delivery means formed with a cooling element removal slot communicating with a lower end of said major portion of said guideway, said retaining and delivery means being adapted to further cool and maintain the cooling element at a predetermined temperature, pending removal therefrom.

2. A coin-operable machine as claimed in claim 1, wherein the cooling element contains a coolant liquid, and wherein said refrigerating compartment is maintained at a temperature level so that said coolant liquid solidifies upon the temperature thereof reaching, or falling below the freezing point of said coolant liquid.

3. A coin-operable machine as claimed in claim 1, wherein the cooling element contains a cooling agent which is gaseous at normal pressure and ambient temperature, but evaporates on reaching, or falling below a predetermined temperature, and wherein said refrigerating compartment is maintained at a temperature level so that said cooling agent evaporates.

4. A coin-operable machine as claimed in claim 1, wherein said major portion of said guideway includes a chute, and further comprising a lock chamber interconnected between said cleaning chamber and said chute, and openable lock chamber closing means.

5. A coin-operable machine as claimed in claim 4, wherein said cooling element cleaning chamber further comprises pivotably hinged cleaning chamber inlet flaps.

6. A coin-operable machine as claimed in claim 5, wherein said cleaning chamber inlet flaps are spring-loaded and normally maintained in a closed position, but are opened when actuated by the weight of a cooling element.

7. A coin-operable machine as claimed in claim 5, wherein said lock chamber closing means include a pair of pivotably hinged lock chamber inlet flaps, and a pair of pivotably hinged lock chamber outlet flaps.

8. A coin-operable machine as claimed in claim 7, wherein said lock chamber inlet flaps are spring-loaded and normally maintained in a closed position, but are opened when actuated by the weight of a cooling element.

9. A coin-operated machine as claimed in claim 7, further comprising control and drive means for controlling at least said lock chamber outlet flaps.

10. A coin-operated machine as claimed in claim 9, wherein said control and drive means control the opening and closing of all of said pivotably hinged flaps.

11. A coin-operated machine as claimed in claim 1, further comprising hot water or steam generating means, hot water or steam spraying means connected to said cleaning chamber for spraying and cleaning incoming cooling elements, and hot water or steam delivery means connecting said hot water or steam generating means to said hot water or steam spraying means.

12. A coin-operated machine as claimed in claim 11, wherein said hot water or steam delivery means includes a hot water or steam supply pipe and a suction and pressure pump interposed in said supply pipe.

13. A coin-operated machine as claimed in claim 11, further comprising a water storage tank, and water delivery means connecting said water storage tank to said hot water or steam generating means.

14. A coin-operated machine as claimed in claim 13, wherein said water delivery means includes a water supply pipe, and a water pump arranged therein.

15. A coin-operated machine as claimed in claim 11, wherein due to the cleaning of said incoming cooling elements by said hot water or steam spraying means dirty water is obtained, and further comprising a dirty water collecting tank, a dirty water drain connection communicating with said bottom opening of said cleaning chamber, and a drain connecting said drain connection with said dirty water collecting tank.

16. A coin-operated machine as claimed in claim 15, wherein said drain is provided with a control valve.

17. A coin-operated machine as claimed in claim 1, further comprising a timer connected to said retaining and deliery means for inhibiting operation of said retaining means and permitting activation of said delivery means only after a predetermined time period set by said timer.

18. A coin-operated machined as claimed in claim 1, wherein the cooling element is a used cooling element, said cleaning chamber being adapted to accept the cooling element for the cleaning thereof.

* * * * *